US005806963A

United States Patent [19]

Miller et al.

[11] Patent Number: 5,806,963

[45] Date of Patent: Sep. 15, 1998

[54] PORTABLE LIGHT TOWER

[75] Inventors: David B. Miller, Advance; Michael Shane Dyson; R. Preston Stockner, both of Mocksville; T. Ray Laws, Advance; Richard L. Ijames; Donald G. Smith, both of Mocksville, all of N.C.

[73] Assignee: Ingersoll-Rand Company, Woodcliff Lake, N.J.

[21] Appl. No.: 791,927

[22] Filed: Jan. 31, 1997

[51] Int. Cl.[6] ..... F21L 13/00

[52] U.S. Cl. ..... 362/192; 362/74; 362/431

[58] Field of Search ..... 123/3; 52/118, 52/121; 362/74, 89, 192, 233, 431, 294, 373

[56] References Cited

U.S. PATENT DOCUMENTS

| | | | |
|---|---|---|---|
| 5,115,606 | 5/1992 | Renegar et al. | 52/118 |
| 5,129,199 | 7/1992 | Miller et al. | 52/121 |
| 5,168,680 | 12/1992 | Matlock | 52/118 |
| 5,524,398 | 6/1996 | Miller et al. | 52/121 |
| 5,550,333 | 8/1996 | Whiteman, Jr. | 362/192 X |
| 5,611,177 | 3/1997 | Herbstritt | 52/111 |

OTHER PUBLICATIONS

L6 and L8 Portable Light Tower Brochure, ©Ingersoll–Rand Company May 1995.

20,30, 50KW Portable Generators Brochure, ©Ingersoll–Rand Company 1992.

*Primary Examiner*—Stephen F. Husar
*Attorney, Agent, or Firm*—Michael M. Gnibus

[57] ABSTRACT

A portable light tower including a frame, and an enclosure supported by the frame. The enclosure defines an enclosure interior having a hot zone, and includes a plurality of inlet apertures and a plurality of discharge apertures. A generator driven by an engine are located in the enclosure interior and the generator and engine emit a hot exhaust gas into the hot zone during operation. The light tower also includes an exhaust chamber located in said hot zone, said exhaust chamber having a floor panel and a fan mounted in said floor panel for drawing the hot gas into the chamber and out the discharge apertures. The chamber is adapted to prevent the backflow of hot gas into the enclosure interior. The tower also includes a unitary forklift and bail plate and at least two retention assemblies located along the exterior of the enclosure for maintaining an enclosure door in open and closed positions.

18 Claims, 8 Drawing Sheets

PORTABLE LIGHT TOWER

BACKGROUND OF THE INVENTION

The invention relates to a portable light tower having an enclosure with an enclosure door, and more particularly to an improved portable light tower where the improved light tower includes an improved system for effectively drawing hot air out of the enclosure, a unitary forklift and bail plate, and at least two enclosure door retention assemblies mounted along the exterior of the enclosure.

Conventional portable light towers are generally comprised of a generator that is driven by an engine to light a plurality of lamps mounted on an extendable tower. The generator and engine are located in an enclosure that is provided with at least one enclosure door. The door allows a light tower operator to easily repair or otherwise service the component parts located in the enclosure.

There are a number of problems associated with conventional portable light towers. First, conventional light towers do not effectively maintain the operating temperature in the enclosure below an acceptable maximum temperature. As a result, the useful lives of mechanical and electrical component parts housed in the enclosure are significantly reduced. A present method for maintaining the interior enclosure temperature below an acceptable threshold includes keeping the enclosure door open during tower operation in order to facilitate ventilation of hot air produced primarily by the generator and engine. This cooling method often fails to provide an outward flow of hot air sufficient to maintain the operating temperature at the required level. Additionally, since the enclosure door serves as a noise muffler when it is closed, opening the enclosure door promotes significant noise emission.

Another method used to maintain operating temperatures below an acceptable maximum is by driving a fan either directly by the engine or by a belt or other conventional means. In this alternate method, the fan is located at one end of the enclosure and as the fan rotates it develops an flow stream which draws hot air through and out of the enclosure and draws cooler ambient air into the enclosure. However, frequently the cool air drawn into the enclosure is mixed with the hot air, reducing the effectiveness of this temperature reduction method.

Another shortcoming of conventional portable light towers is related to the enclosure door for accessing the interior of the enclosure. When the door is in the open position, it is held open by a gas spring or a prop-rod. The free end of the prop-rod is wedged against the door to keep it open. The prop-rod is not a reliable means for keeping the door open because the prop-rod may be easily dislodged from its wedged position by inadvertent minimal contact, allowing the door to close. If the door closes unexpectedly, the technician repairing the tower may be injured.

Like the prop-rod, the gas spring has shortcomings. The primary operational shortcoming is that the gas spring is typically not lockable. When gas springs are used, the enclosure door slowly closes as the spring returns to its compressed length. Additionally, known gas springs are quite susceptible to leaks and are not as effective when used in extreme temperatures.

A third shortcoming of known light towers relates to the means for lifting the light tower unit from one location to another, for example onto or off of a flat bed truck. Typically, a pair of channels adapted to receive the forks of a forklift are welded to the tower and a discrete bail plate is welded to the tower. The channels and plate require a large number of welds and must be located in different positions on the tower depending on the weight of the tower.

The foregoing illustrates limitations known to exist in present light towers and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a portable light tower including a frame, and an enclosure supported by the frame. The enclosure defines an enclosure interior having a hot zone, and includes a plurality of inlet apertures and a plurality of discharge apertures. A generator and an engine which drives the generator are located in the enclosure interior and the generator and engine emit a hot exhaust gas into the hot zone during operation. The light tower also includes an exhaust chamber located in said hot zone, the exhaust chamber has a plenum floor panel and a fan mounted in the floor panel for drawing the hot gas into the chamber and out the discharge apertures. The chamber is adapted to prevent the backflow of hot gas into the enclosure interior.

In other aspects of the invention, the light tower also includes a unitary forklift and bail plate and at least two retention assemblies located along the exterior of the enclosure for maintaining an enclosure door in open and closed positions.

The foregoing and other aspects will become apparent from the following detailed description of the invention when considered in conjunction with the accompanying drawing figures.

DESCRIPTION OF THE DRAWING FIGURES

Figure 1:
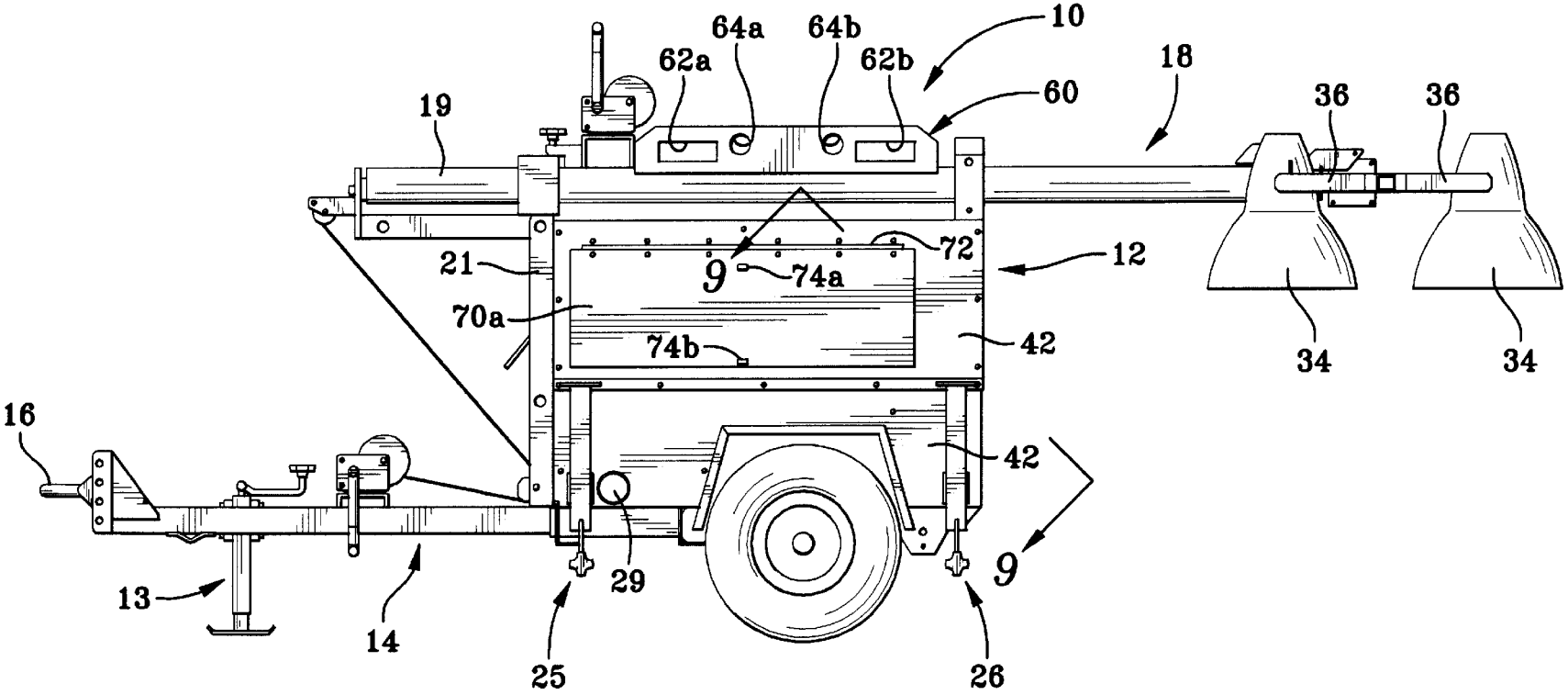
FIG. 1 is a left elevational view of the portable light tower of the present invention.
Figure 9:
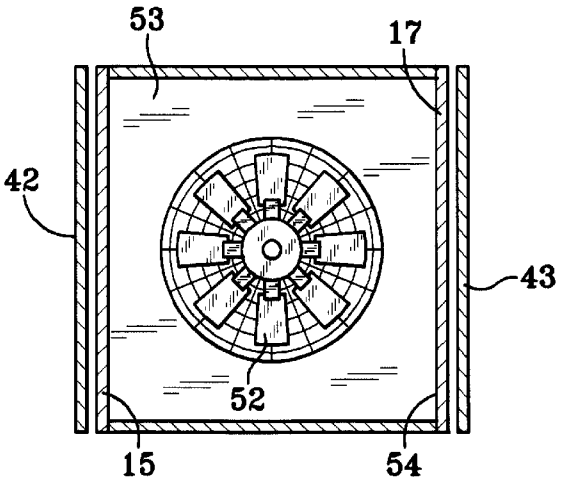
Figure 6:
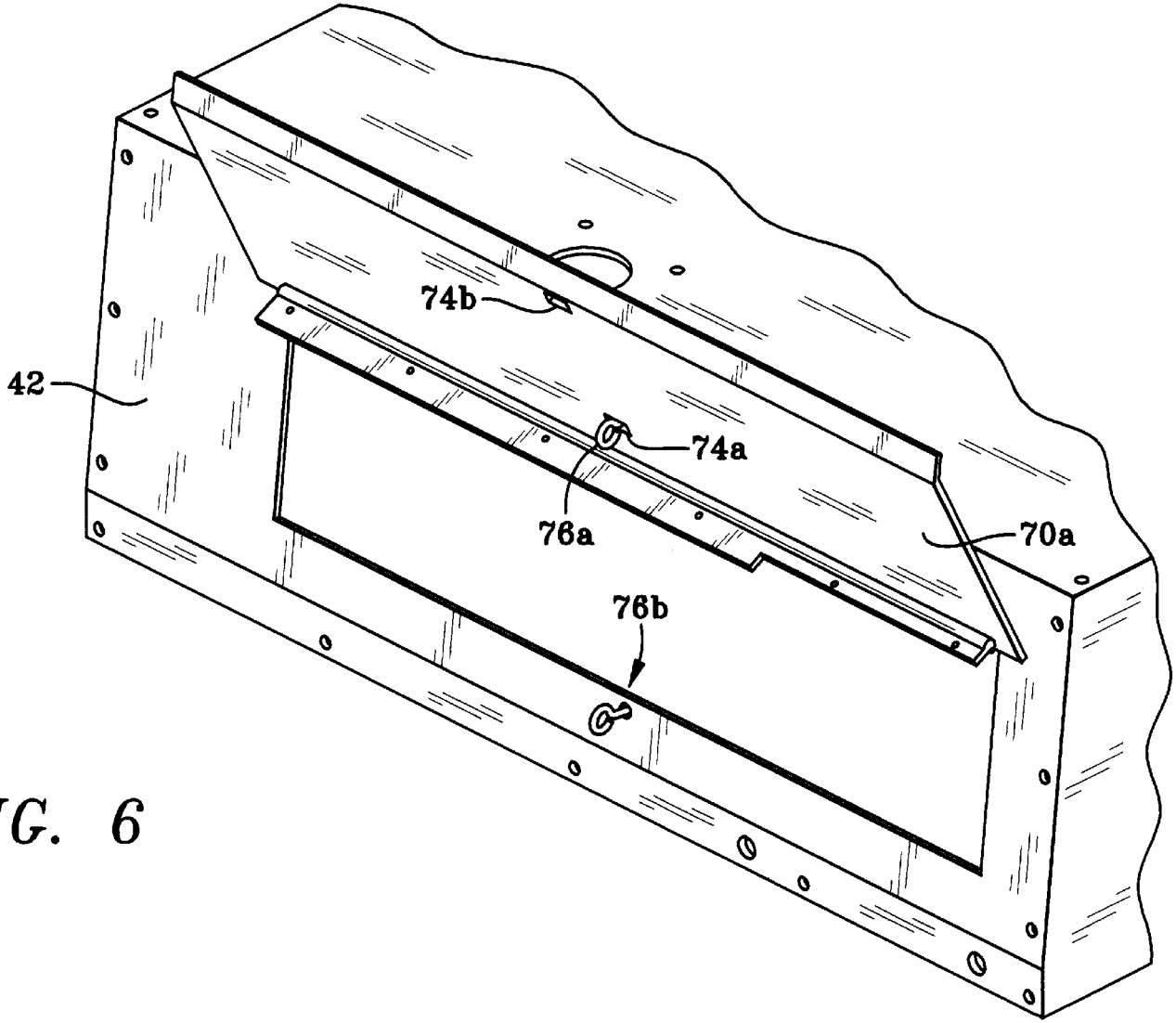
FIG. 6 is an enlarged view of the enclosure door, showing the enclosure door in the open position and kept open by a retention member.
Figure 7A:
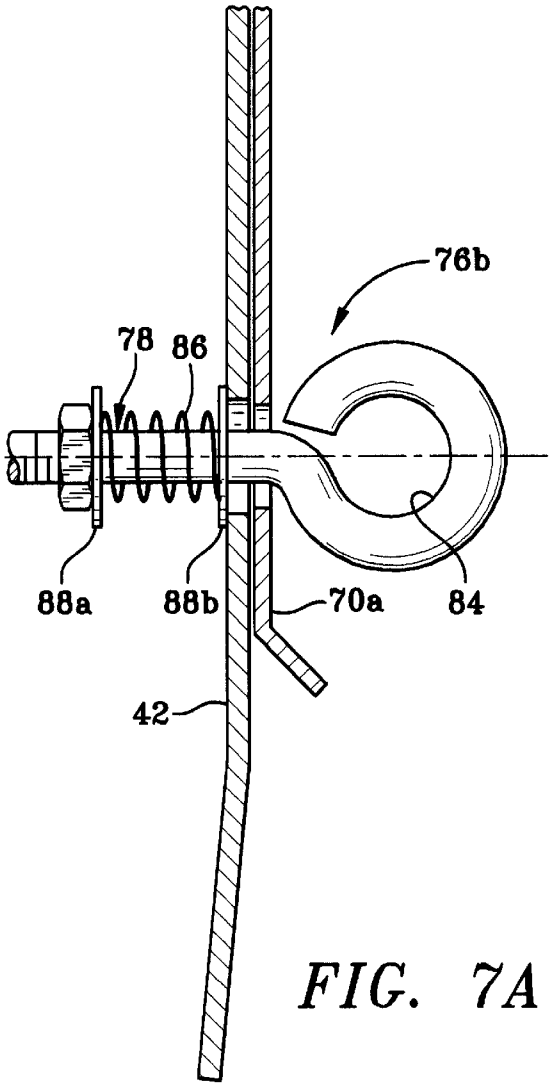
Figure 7B:
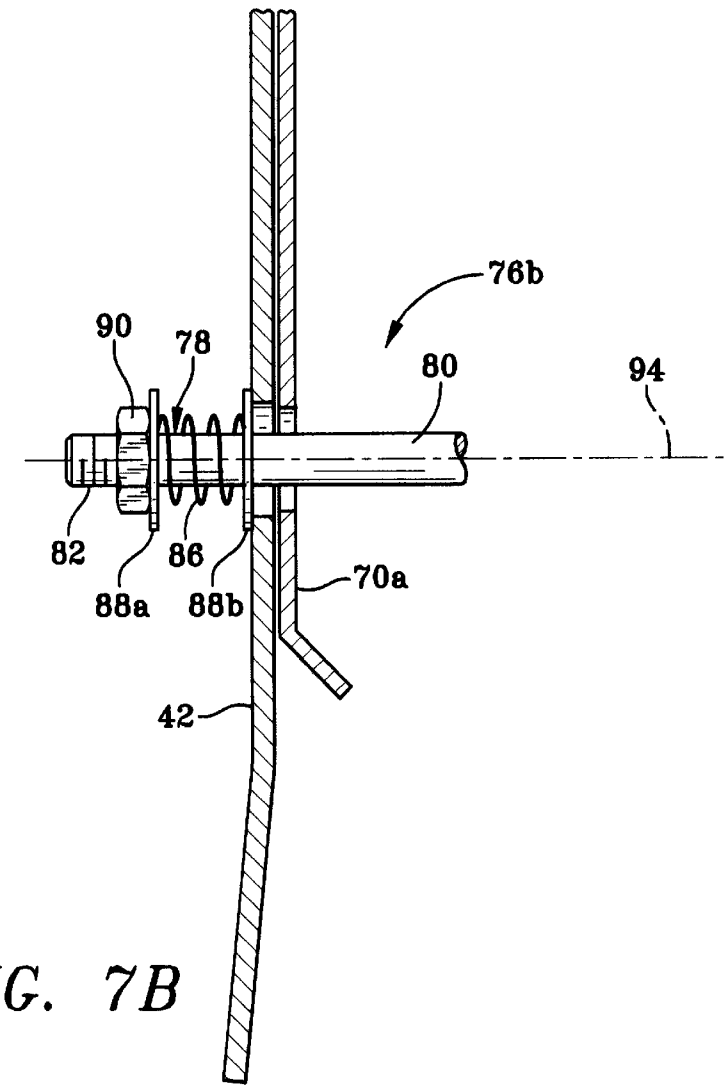
Figure 8:
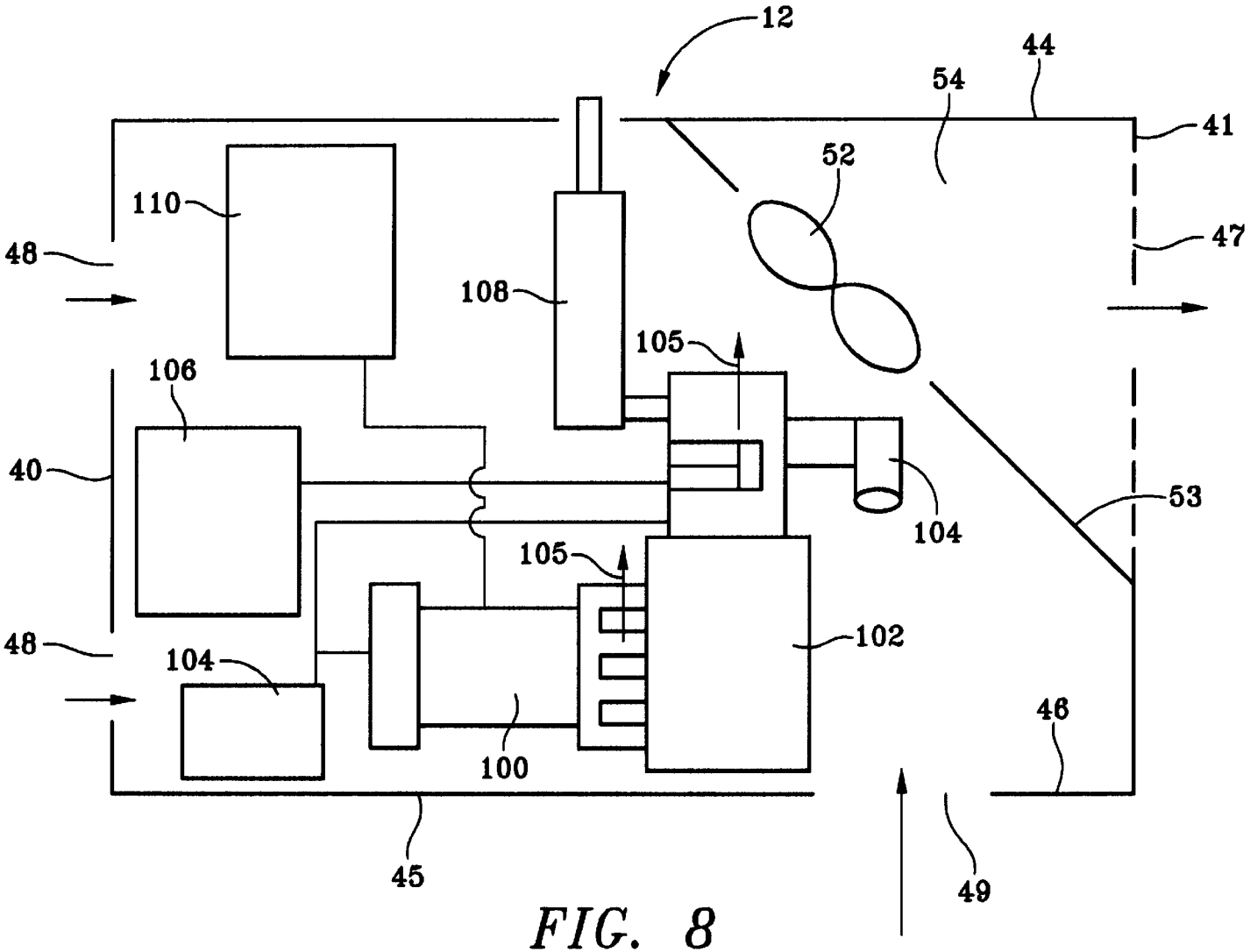

FIG. 7*a* is an enlarged view of the locking means of FIG. 6 with the retention member in a first position;

FIG. 7*b* is an enlarged view of the locking means of FIG. 7*a* with the retention member in a second position;

FIG. 8 is a schematic representation of a number of the components located in the enclosure; and FIG. 9 is a sectional view taken along line 9—9 of FIG. 1.

DESCRIPTION OF THE PREFERRED EMBODIMENT

Turning now to the drawings wherein like parts are referred to by the same number throughout the several views, FIGS. 1–5 generally illustrate the portable light tower 10 of the present invention. The light tower includes an enclosure 12 that is supported by a running gear or frame 14.

The running gear is adapted to be connected to a truck or other suitable vehicle by a conventional hitch 16.

Light tower 10 includes a movable tower assembly 18 including at least one light tower member that is movable between a retracted, first position substantially parallel to the running gear, as shown in FIG. 1 and an extended, second position (not shown) substantially perpendicular to the running gear 14. For purposes of describing the preferred embodiment, light tower 10 has three tower members, a first tower member 19, fixed to anchor tower member 21; and second and third tower members 22, and 23, nested in first tower member 19. The three tower members are movable relative to the anchor tower member between the first and second positions by a conventional system of winches, cables and pulleys well known to one skilled in the art. A lamp support bar 32 is fixed to the free end of the third movable tower member 23 transverse to the third tower member and a plurality of lamps 34 are fixed to the support bar by brackets 36.

As shown most clearly in FIG. 1, unitary bail and forklift plate 60 is fixedly attached to tower member 19. The plate is welded to the member 19 transverse to the tower member so that when the tower member 19 is in the first retracted position, the plate 60 is located above enclosure 12 and is readily accessible to a crane, forklift or other device used to lift the light tower. The plate is attached to the tower member 19 by a single weld connection however, any suitable connection means may be used.

The plate 60 is elongated and includes first and second forklift apertures 62*a* and 62*b* located at the ends of the plate, and a pair of bail lift apertures 64*a* and 64*b* spaced between the forklift apertures. The forklift apertures 62*a* and 62*b* are rectangular and are therefore adapted to receive forks of a conventional forklift. The bail apertures 64*a* and 64*b* are circular and are adapted to receive a hook member.

Plate 60 simplifies assembly of tower 10. By plate 60, the conventional discrete lifting channels and bail plates attached to the top of the enclosure by a number of welds, are eliminated. As the weight of the tower and the associated tower center of gravity vary, the operator lifting the tower may utilize either the bail aperture most closely associated with the tower's center of gravity or the forklift apertures, to lift the tower package.

The enclosure 12 of light tower package 10 will now be described. The enclosure 12 is comprised of a front panel 40, a rear panel 41, left side panel 42, right side panel 43, top panel 44, and bottom panel 45. The panels together define enclosure interior 46. Enclosure doors 70*a* and 70*b* are hingeably connected to right and left panels 42 and 43 by hinges 72 and allow a tower operator to gain access to the enclosure interior 46. Slots 74*a* and 74*b* are provided on the enclosure doors. Retention assemblies 76*a* and 76*b* are provided along the side panels and maintain the doors in the desired open and closed positions. The retention assemblies will be described in greater detail hereinafter.

Figure 3:
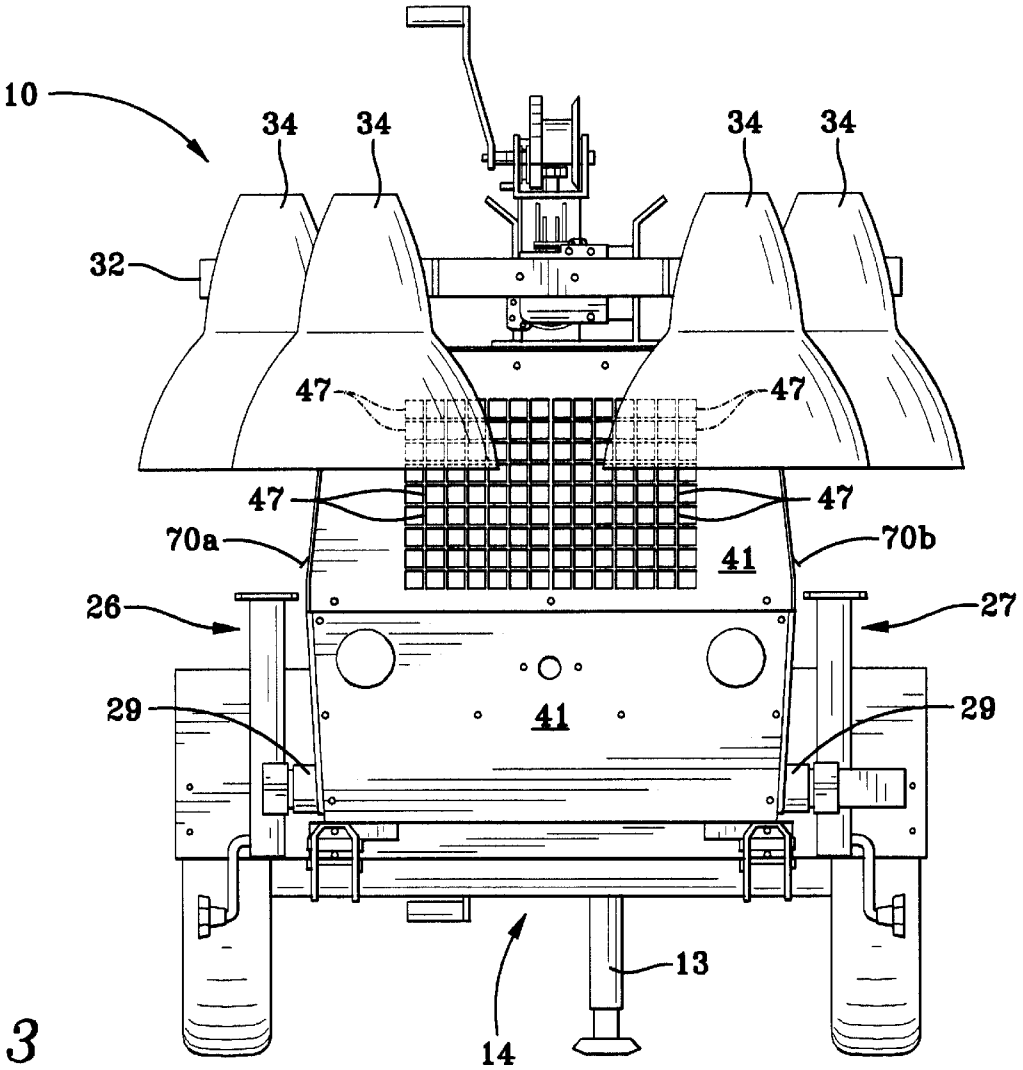
FIG. 3 is a rear elevation view of the portable light tower of FIG. 1.
Figure 4:
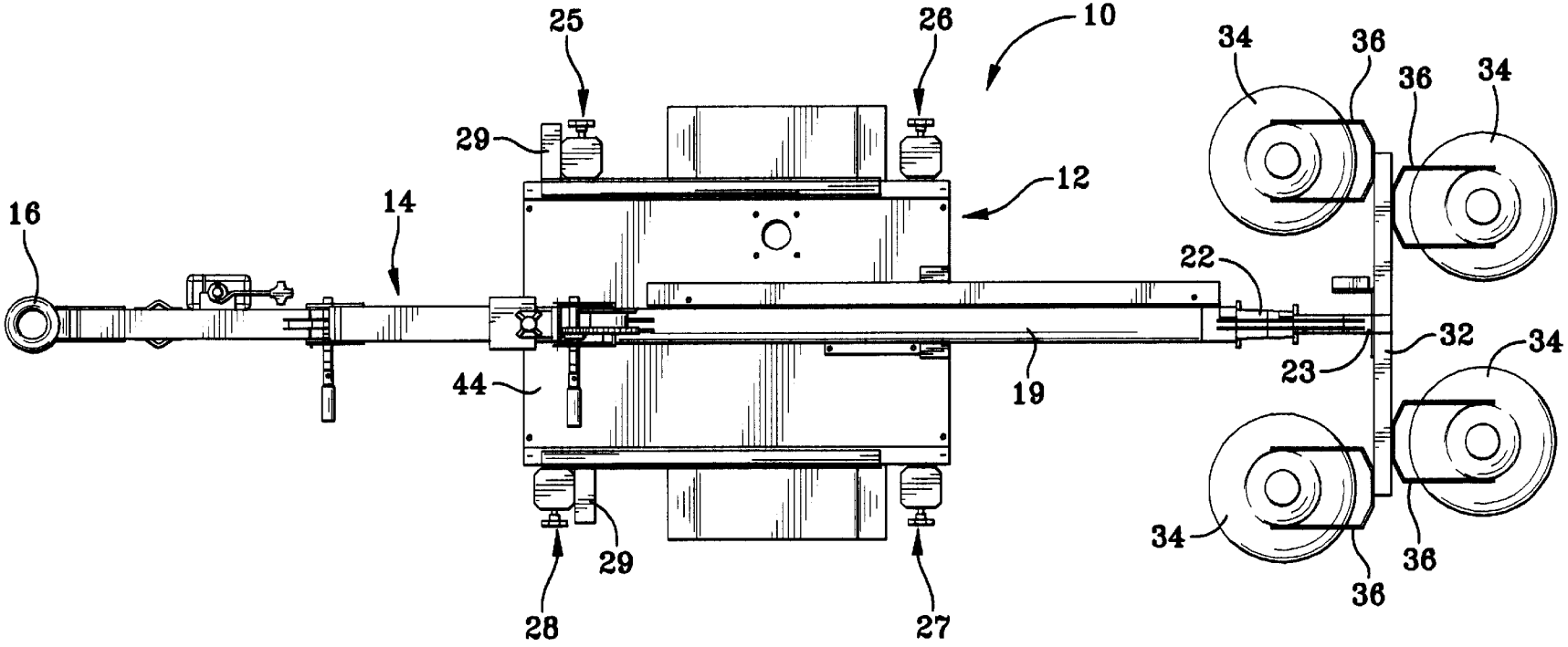
FIG. 4 is a top plan view of the portable light tower of FIG. 1.

As shown in FIG. 3, a plurality of discrete exhaust openings 47 are provided on rear panel 41. Each exhaust opening is substantially square but may be any suitable shape. The exhaust openings are arranged in an 14×9 matrix along the rear panel. Hot exhaust gases are exhausted out of the enclosure interior 46 through openings 47.

Figure 2:
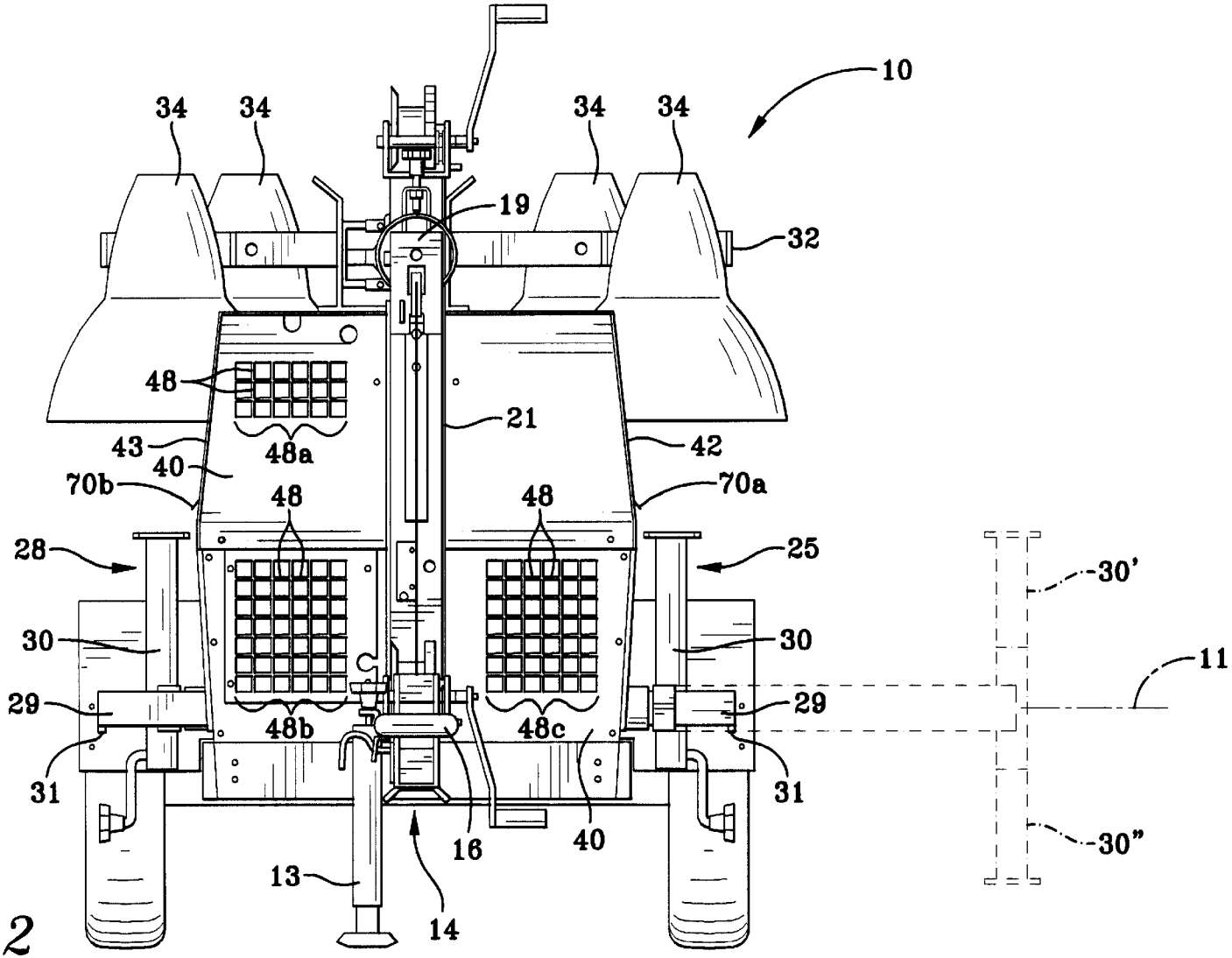
FIG. 2 is a front elevation view of the portable light tower of FIG. 1.

In addition to openings 47, a plurality of discrete inlet flow openings 48 are provided on front enclosure panel 40. Like openings 47, each opening 48 is square however the openings 48 may be any suitable shape. As shown in FIG. 2, the inlet openings are arranged into three discrete groupings or matricies 48*a*, 48*b*, and 48*c*. Matricies 48*b* and 48*c* are 6 openings wide×7 openings high. Matrices 48*a* is 6 openings wide×3 opeinings high. Ambient air is drawn into the enclosure interior 46 through the inlet openings 48.

Although the openings on the front and rear panels are shown arranged in specifific matricies or groupings, any suitable number of openings 48 and 47 arranged in any suitable pattern may be provided on the front and rear panels.

Figure 5:
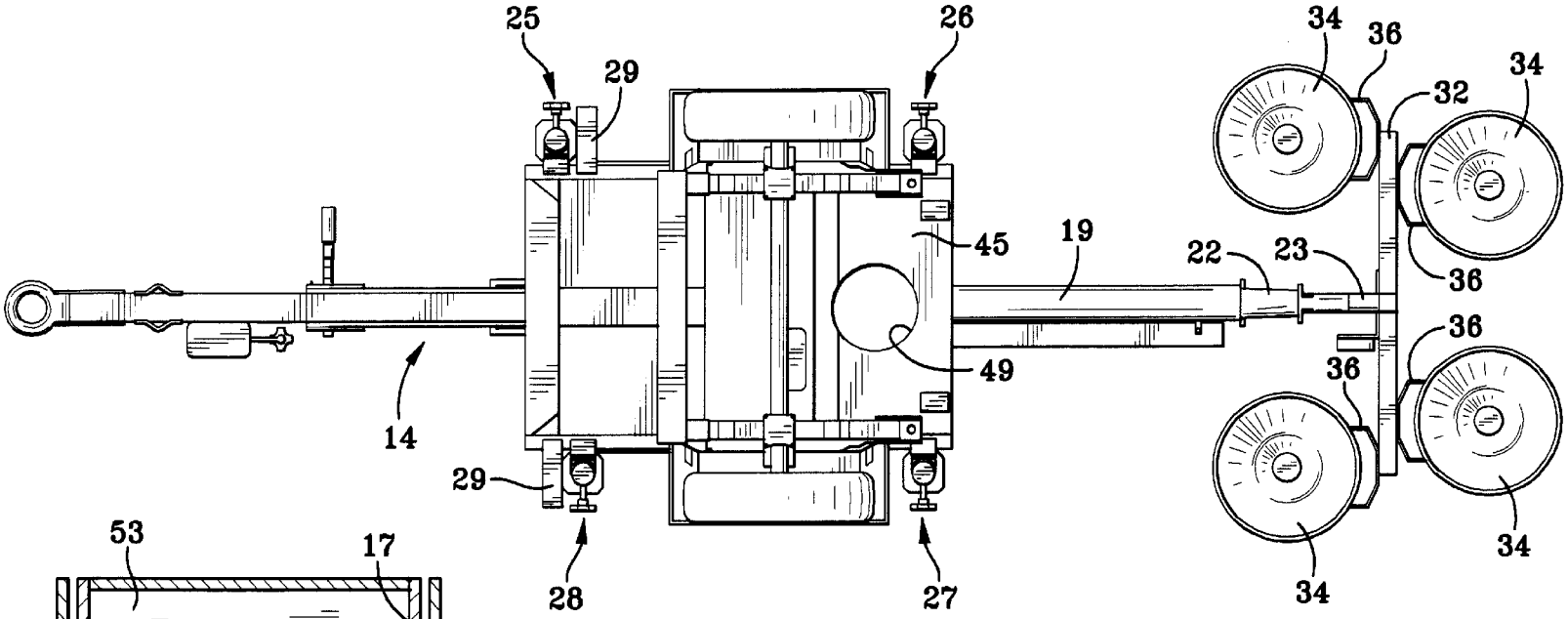
FIG. 5 is a bottom plan view of the portable light tower of FIG. 1.

In addition to openings 47 and 48, an inlet opening 49 is provided in bottom panel 45. Ambient air is drawn into the enclosure interior 46 through the opening 49. As shown in FIG. 5, the opening is located adjacent the rear end of the enclosure and is circular.

Four like tower outrigger support assemblies 25, 26, 27, and 28 and running gear jack 13 are used to prevent the tower from tipping during use and are also used to level the tower when it is positioned for use on sloped or uneven ground. The jack is conventionally connected to the running gear drawbar as shown in FIGS. 1–5 and is extendable and retractable by a conventional crank assembly. Outrigger assemblies 25 and 28 are movably located at the front of the enclosure respectively adjacent left and right panels 42 and 43; and outrigger assemblies 26 and 27 are located at the rear of the enclosure also respectively adjacent the right and left enclosure panels.

Each outrigger assembly includes a shaft 29 with a crank assembly 30 fixed to one shaft end and a stop member 31 at the opposite end of the shaft. The shaft, stop member, and crank assembly are movable as a single unit. Each outrigger assembly includes the same component parts and may be repositioned in the same way so that as the description proceeds outrigger assembly 25 will be described.

Referring now to FIG. 2, outrigger assembly may be repositioned away from or toward the enclosure by extending or shortening the shaft 29. In order to reposition the outrigger assembly, the shaft is moved linearly along an outrigger axis 11. The shaft is supported along its length by flanges (not shown) located in the enclosure interior 46. Once the shaft has been moved the required amount, the shaft is rotated 180 degrees about axis 11, and the crank assembly 30 is repositioned from non-support orientation 30' to support orientation 30". Stop member 31 prevents the shaft from being overextended by contacting the enclosure when the shaft reaches its maximum extension length.

The shaft members 29 of the rear outrigger assemblies 26 and 27 are not as long as the shafts of the front assemblies 25 and 28 however the rear assemblies are repositioned in the same manner as previously described for assembly 25. Conventional locking pins lock the assemblies in the desired operating positions.

A schematic representation of the components located in enclosure interior 46 is provided in FIG. 8. Generally, as shown in FIG. 8, generator 100 is directly driven by engine 102. Engine combustion air enters the engine combustion chamber through inlet 104. Hot air from the engine and generator are flowed upward in the direction of arrows 105 and thereby define a hot zone in enclosure interior 46. Also included in interior 46 are engine battery 104, engine fuel tank 106, muffler 108 and light control ballast 110. All of the components located in interior 46 are conventional and well known to one skilled in the art with the exception of cooling system exhaust chamber 54. Accordingly, the components will not be described further.

Exhaust chamber 54 is defined along the sides by side panels 15 and 17 that are parallel to enclosure side panels 42 and 43, along the top by top panel 44, along the rear by rear panel 41 and along the front and bottom by floor plenum panel 53. The plenum floor is sloped at about 45 degrees relative to rear panel 44 as shown in FIG. 8, and joins the sides, rear and top panels. The plenum floor panel serves as a divider between the chamber 54 and the enclosure interior 46. The chamber is located along the top of the interior 46, in the enclosure interior hot zone. A fan 52 is mounted for use in an opening in the floor panel and serves to draw hot gases from the hot zone into the chamber 54 and force the captured hot gas out the exhaust openings 47. Once the hot gas is flowed into the chamber 54, the gas does not flow back into the interior 46. In operation, the hot gas is drawn into chamber 54 and out exhaust apertures 47 and relatively cool ambient air is drawn into the interior through inlet apertures 48 and opening 49. In this way, the temperature in the interior 46 remains below a predetermined acceptable maximum and the useful lives of the components in the enclosure interior are maximized.

The enclosure doors 70*a* and 70*b* and retention assemblies will now be described. For purposes of the description of the preferred embodiment, since the enclosure doors are the same, only door 70*a* will be described. Door 70*a* is movable between the closed position shown in FIG. 1 and the open position shown in FIG. 6. The retention slots 74*a* and 74*b* are respectively adjacent the hinge 72 and free edge of the door. The openings include a longitudinal portion that is longer than the lateral portion.

When the door is moved to the open and closed positions, the door is locked in place by like retention assemblies 76*a* and 76*b* respectively. Retention assembly 76*a* is located adjacent the hinge 72 and retention assembly 76*b* is located adjacent the free edge of the enclosure door.

As shown in FIGS. 7*a* and 7*b*, retention assembly 76*b* is comprised of a unitary retention member 78 that has a first end 80, a second end 82, and an aperture 84 at the first end of the member 78. The retention assembly also includes a spring or biasing member 86 that is located along member 78 between the ends 82 and interior portion of sidewall 42. The spring is sandwiched between two washers or other rigid plates 88*a* and 88*b*. A nut 90 is threadably fastened to end 82 and is tightened against washer 88*a* to compress spring 86 and thereby bias member 78 inwardly against door 70. The first end is in alignment with lateral portion of retention slot 74*b* which has a length that is less than the diameter of the first end. In this way, the door is kept closed when it is in the open and closed positions.

When it is necessary to open the door, member 78 is pulled linearly along axis 94 and spring 86 is compressed. See FIG. 7*b*. The member 78 is then rotated ninety degrees about axis 94 so that first end 80 is in alignment with the longitudinal portion of slot 74*a*.

As the door reaches the open position, the first end of retention member 78 of retention assembly 76*a* is passed through the longitudinal portion of opening 74*a*. See FIG. 6. Once the door is in the open position, the retention member 78 is rotated ninety degrees into alignment with the lateral portion of slot 74*a* thereby maintaining the door in the open position.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A portable light tower, comprising:

a) a frame;

b) an enclosure supported by the frame, said enclosure defining an interior having a hot zone, inlet aperture means for drawing inlet gas into the interior and a discharge aperture means, the enclosure including a first side panel, a second side panel, a rear panel and a top panel;

c) generator means driven by an engine means, both said means located in said interior, said generator and engine means adapted to emit hot gas during operation, said hot gas emitted into a hot zone; and d) an exhaust chamber located in said hot zone, said exhaust chamber including a plenum floor panel joining the enclosure side, top, and rear panels to define the exhaust chamber wherein the plenum floor panel is oriented at a 45 degree angle relative to the rear panel, said exhaust chamber having a means for drawing the hot gas into the chamber and out the discharge aperture means, said chamber adapted to prevent the backflow of hot gas into the interior.

2. The portable light tower as claimed in claim 1, the portable light tower further comprising an enclosure door movable between an open position and a closed position, and first retention means mounted along said enclosure for maintaining the door in the open position.

3. The portable light tower as claimed in claim 2, further comprising second retention means mounted along said enclosure sidewall for maintaining the door in the closed position.

4. The portable light tower as claimed in claim 2, the first retention means comprising: a retention member having a first end and a second end, a first plate, a second plate, a biasing member located between the plates, and a compressing member connected to the retention member at the second end.

5. The portable light tower as claimed in claim 4 wherein the biasing member is a coil spring.

6. The portable light tower as claimed in claim 4 wherein the retention member includes an aperture at the first end and the retention member is movable linearly along an axis, and rotatable about said axis when the first and second retention means are located along the enclosure sidewalls.

7. The portable light tower as claimed in claim 1, the portable light tower further comprising a unitary plate adapted to be attached to the light tower member, said plate including at least two forklift apertures and at least two bail apertures.

8. The portable light tower as claimed in claim 7 wherein the bail apertures are substantially circular and the forklift apertures rectangular.

9. The portable light tower as claimed in claim 7 wherein the at least two bail apertures are located between the at least two forklift apertures.

10. The portable light tower as claimed in claim 1 wherein said means for drawing hot gas into the chamber is a fan.

11. A portable light tower, comprising:

a) a frame;

b) an enclosure supported by the frame, said enclosure including a first side panel, a second side panel, a first end panel, a second end panel, and a top panel, said panels defining an enclosure interior, said enclosure first end panel including inlet aperture means for drawing inlet gas into the interior, and enclosure second end panel including discharge aperture means for flowing a hot fluid out of the interior;

c) an exhaust chamber located in said interior, said exhaust chamber including a plenum floor panel joining the enclosure side panels, top panel, and second end panel to define the exhaust chamber wherein the plenum floor panel is oriented at an angle relative to the second end panel, said exhaust chamber having a means for drawing the hot fluid into the chamber and out the discharge aperture means, said chamber adapted to prevent the backflow of hot fluid into the interior; and d) generator means driven by an engine means, both said means located in said interior below said plenum, so that during operation of said generator and engine means, hot fluid emitted by the generator and engine means is drawn into the exhaust chamber and out the discharge aperture means.

12. The portable light tower as claimed in claim 11 wherein the plenum is oriented at an angle of 45 degrees relative to the second end panel.

13. The portable light tower as claimed in claim 11 wherein the first end panel is the front end panel and the second end panel is the rear end panel of the enclosure.

14. The portable light tower as claimed in claim 11 wherein the means for drawing hot fluid into the exhaust chamber is a fan.

15. A portable light tower, comprising:

a) a frame;

b) an enclosure supported by the frame, said enclosure having a first end panel, a second end panel, a first side panel and a second side panel extending between the first and second end panels, a top panel, said first and second end panels, said first and second side panels and said top panel defining an interior having a hot zone, said first end panel having inlet aperture means for drawing fluid into the interior, said second end panel having discharge aperture means for discharging fluid out of the interior;

c) a plenum extending between the first and second side panels, the top panel and the second end panel, said plenum, first and second side panels, top panel and second end panel defining an exhaust chamber, said plenum being oriented at an angle relative to the second end panel, said exhaust chamber being in fluid transmitting relation with said discharge aperture means;

d) means for powering the light tower, said means located in said interior, below said plenum, said means for powering the light tower adapted to emit a hot fluid during operation; and e) means for drawing the hot fluid upward into the exhaust chamber and out the discharge aperture means, said means for drawing the hot fluid located in said plenum.

16. The portable light tower as claimed in claim 15 wherein the first end panel is located at the front of the portable light tower and the second end panel is at the rear of the portable light tower, so that the inlet fluid flows through the front of the compressor, and the hot fluid is discharged out the rear of the compressor enclosure.

17. The portable light tower as claimed in claim 15 wherein the plenum is oriented at an angle of 45 degrees relative to the second end panel.

18. The portable light tower as claimed in claim 15 wherein the means for drawing hot fluid into the exhaust chamber is a fan.

* * * * *